United States Patent [19]

Baumgart

[11] Patent Number: 4,719,836

[45] Date of Patent: Jan. 19, 1988

[54] DRUMSTICKS FOR USE WITH PERCUSSION INSTRUMENTS

[76] Inventor: Harry Baumgart, Am Röhrbrunnen 8, D-6521 Dorn-Dürkheim, Fed. Rep. of Germany

[21] Appl. No.: 927,740

[22] Filed: Nov. 5, 1986

[51] Int. Cl.[4] ..... G10D 13/02

[52] U.S. Cl. ..... 84/422 S; D17/22

[58] Field of Search ..... D17/22; 84/422 S

[56] References Cited

U.S. PATENT DOCUMENTS 3,866,508 2/1975 Huslig ..... 84/422 S
3,893,364 7/1975 Harrison ..... 84/422 S
4,476,768 10/1984 Willis ..... 84/422 S
4,488,470 12/1984 Larrain ..... 84/422 S

*Primary Examiner*—Lawrence R. Franklin
*Attorney, Agent, or Firm*—Peter K. Kontler

[57] ABSTRACT

The drumstick for the left hand has three recesses in the peripheral surface, one for a portion of the palm in the region of the short flexor of the thumb, another for the ring finger, and the third for the middle finger. The drumstick for the right hand has a first recess for the thumb and a second recess for the index finger. The recesses enable the user to repeatedly hold the drumsticks in optimum positions to beat a drum or another percussion instrument.

9 Claims, 2 Drawing Figures

DRUMSTICKS FOR USE WITH PERCUSSION INSTRUMENTS

BACKGROUND OF THE INVENTION

The invention relates to drumsticks for use with drums and other types of percussion instruments.

As a rule, the drumsticks are made of wood. Each drumstick is normally held in such position that its center of gravity is located in an imaginary extension of the forearm of the respective hand in order to ensure that the user can pivot the drumsticks back and forth with a minimum of effort. It is well known that certain players pivot the drumsticks at a very high frequency which can result in fatigue as well as in deviation from the desired rhythm if the drumsticks are not properly held. Moreover, perspiration can cause the drumsticks to slide relative to the hands and to be difficult to handle with a minimum of ease and in an optimum way.

The center of gravity of a drumstick is normally closer to one than to the other end of the implement. The reason is that one end portion of the drumstick normally tapers in a direction toward the knob which strikes the instrument and, therefore, the center of gravity is nearer to the end which is remote from the knob.

Presently known drumsticks have smooth cylindrical peripheral surfaces which do not facilitate rapid and predictable reengagement by the fingers of the respective hands, especially if the fingers and/or the palms of the hands are wet from perspiration. This creates problems when the drumsticks are to be reused at frequent intervals because the player is likely to engage different portions of the drumsticks and is thereby likely to miss the beat or to interrupt the beating of the instrument for an interval of time which is required by the hands to engage the drumsticks in an optimum way.

OBJECTS AND SUMMARY OF THE INVENTION

An object of the invention is to provide novel and improved drumsticks which are constructed in such a way that they can be held in optimum positions to beat a drum or another percussion instrument even if the player does not wish or cannot observe the drumsticks for the purposes of properly holding them by the palms and/or fingers of the respective hands.

Another object of the invention is to provide drumsticks which can be properly engaged and held by perspiring hands.

A further object of the invention is to provide drumsticks which can be manufactured at a cost not exceeding that of conventional drumsticks even though their manipulation is simpler, more convenient and less tiresome than that of heretofore known drumsticks.

An additional object of the invention is to provide a novel and improved drumstick for use by the right hand of a player.

Another object of the invention is to provide a novel and improved drumstick for use by the left hand of the player.

Still another object of the invention is to provide a novel and improved method of forming drumsticks in such a way that the player can properly engage each drumstick without looking at the implement and irrespective of the intensity of illumination in the area where the drumsticks are put to use.

An additional object of the invention is to provide drumsticks which can be manipulated with equal or similar ease by children, adolescents or adults and which are handier to manipulate than conventional drumsticks without detracting from their appearance.

The invention is embodied in a set of drumsticks comprising a first drumstick for the left hand and a second drumstick for the right hand. Each drumstick has an elongated body including a substantially cylindrical portion having a peripheral surface provided with at least one recess to facilitate engagement of the drumstick by the respective hand in a predetermined position to beat a drum or a like instrument. In accordance with a presently preferred embodiment of the invention, the peripheral surface of the first drumstick (for the left hand) has a first recess for a portion of the palm in the general region of the short flexor of the thumb, a second recess for the ring finger, and a third recess for the middle finger. The peripheral surface of the second drumstick (for the right hand) has a first recess for the thumb and a second recess for the index finger. The first recess of the first drumstick is or can be elongated in the longitudinal direction of the respective body, the second recess of the first drumstick can have a substantially circular outline, and the third recess of the first drumstick can have a substantially oval outline, the same as the recesses of the second drumstick. The first and second recesses of the first drumstick are preferably disposed at one side and the third recess is preferably disposed at the other side of the first drumstick, preferably diametrically or nearly diametrically opposite the second recess. The first and second recesses of the second drumstick are or can be disposed substantially diametrically opposite each other.

The recesses of the drumsticks are preferably bounded by cushions, e.g., soft layers made of leather or other material which preferably absorbs moisture. The drumsticks can be made of wood and the recesses are preferably nearer to one than to the other end portion of each drumstick, particularly if (save for the presence of the recesses) the configuration of the improved drumsticks matches or approximates that of conventional drumsticks.

The novel features which are considered as characteristic of the invention are set forth in particular in the appended claims. The improved drumsticks themselves, however, both as to their construction and the mode of manipulating the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
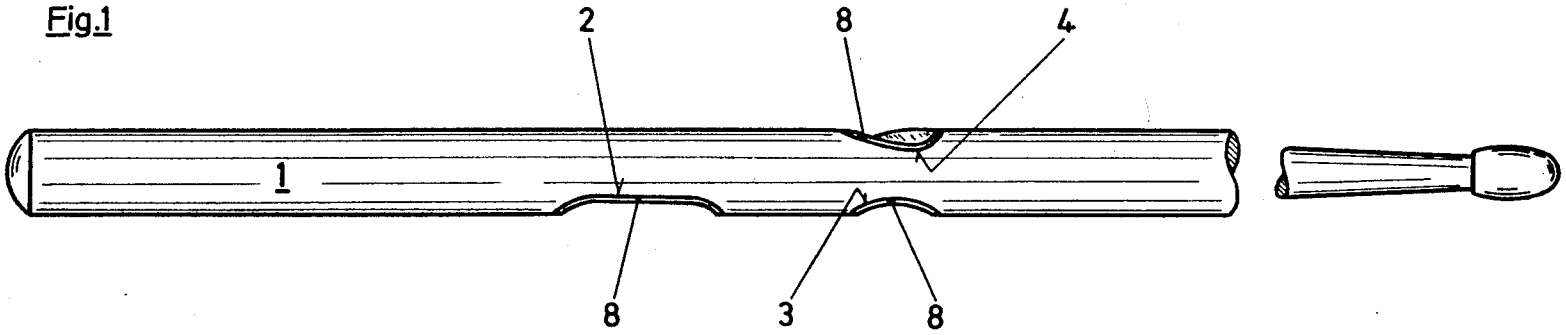
FIG. 1 is a fragmentary elevational view of the drumstick for use by the left hand.

FIG. 1 shows a portion of the drumstick for the left hand of the user drawn to scale. The drumstick comprises an elongated body portion 1 including a cylindrical peripheral surface with three recesses 2, 3 and 4. The recess 2 is elongated in the longitudinal direction of the body portion 1 and serves to receive a portion of the palm in the region of the short flexor of the thumb, the recess 3 serves to accommodate a portion of the ring finger and has a substantially circular outline, and the recess 4 has a substantially oval outline and serves to receive a portion of the middle finger. The recesses 2, 3 are located at one side and the recess 4 is located at the other side of the body portion 1, and the recess 4 is disposed diametrically opposite the recess 3.

Figure 2:
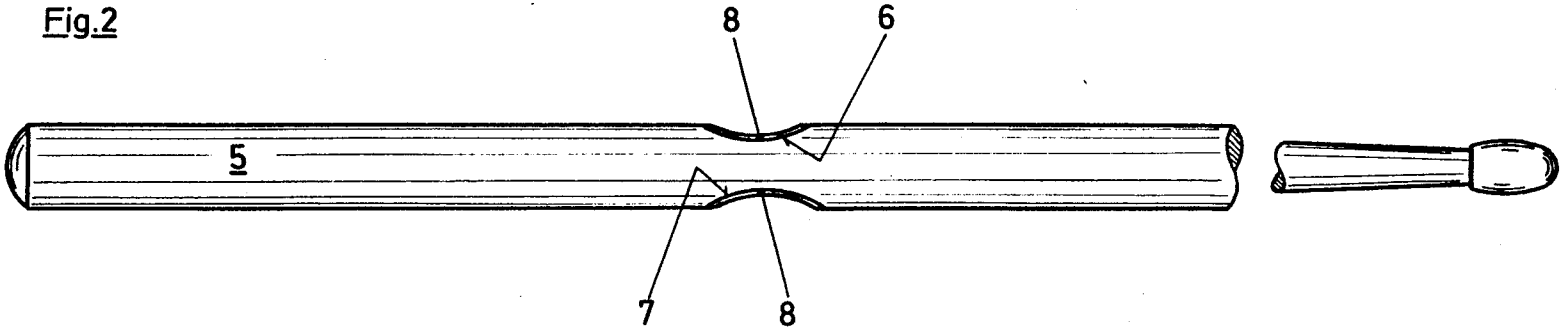
FIG. 2 is a similar fragmentary elevational view of the drumstick for use by the right hand.

The drumstick for the right hand is shown in FIG. 2. It comprises an elongated body portion 5 having a cylindrical peripheral surface with two recesses 6 and 7 which are disposed substantially diametrically opposite each other. These recesses are substantially oval; the recess 6 can receive a portion of the thumb and the recess 7 can receive a portion of the index finger of the right hand.

It is presently preferred to provide the drumsticks with cushions 8, one in each of the recesses, 2, 3, 4, 6 and 7. Each such cushion can consist of or comprise a patch of leather which is glued to the surface bounding the respective recess. It is preferred to make the cushions of a soft and absorbent leather or any other suitable material (e.g., a foamed plastic substance) whose presence can be readily detected by the respective hand to facilitate rapid and predictable engagement of the drumsticks in optimum positions for use. Absorbent cushions are desirable and advantageous because they can gather perspiration when the drumsticks are in actual use. Moreover, soft and absorbent cushions are more likely to enable the user to maintain the respective drumsticks in optimum positions for extended periods of use.

The aforediscussed distribution of recesses in the two drumsticks has been found to ensure that each drumstick can be repeatedly maintained in an optimum position to beat a drum or another percussion instrument as well as to facilitate rapid and practically automatic shifting of the drumsticks to such optimum positions without necessitating any attention on the part of the user. This, in turn, ensures that the user can play the percussion instrument with a minimum of effort and in proper rhythm.

As a rule, the recesses 2, 3 and 4 will be be located nearer to one than to the other longitudinal end of the respective drumstick, namely nearer to the end which is remote from the drum-engaging portion of the drumstick. The same applies for the recesses 6, 7 in the peripheral surface of the body portion 5 of the drumstick for the right hand which, too, is drawn to or close to size. By way of example, the distance between the left-hand end of each drumstick and the respective recesses can equal or approximate one-third of the overall length of the respective drumstick. This ensures that the center of gravity of each drumstick is at or close to the respective recesses.

As a rule, the drumsticks will or can be made of wood. However, the invention can be embodied with equal or similar advantage in drumsticks which are made of another material in addition to or in lieu of wood.

An important advantage of the improved drumsticks is that they can be made handier than conventional drumsticks at no cost at all or at a minimal additional cost. Proper positioning of the drumsticks in the hands takes up a minimum amount of time and the recesses ensure that each drumstick can be located in an optimum position as often as desired. The provision of a larger number of recesses in one of the drumsticks enables the user to rapidly detect the drumsticks for the left and right hands.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A set of drumsticks comprising a first drumstick for the left hand and a second drumstick for the right hand of the user, each of said drumsticks having an elongated body including a substantially cylindrical portion having a peripheral surface provided with recesses to facilitate engagement of the drumstick by the respective hand in a predetermined position to beat a drum or a like instrument, the peripheral surface of said first drumstick having a first recess for a portion of the palm in the region of the short flexor of the thumb, a second recess for the ring finger and a third recess for the middle finger, the peripheral surface of said second drumstick having a first recess for the thumb and a second recess for the index finger, and further comprising a cushion provided in at least one of said recesses.

2. The set of drumsticks according to claim 1, wherein at least one of said drumsticks contains wood.

3. The set of drumsticks according to claim 1, wherein the first recess of said first drumstick is elongated in the longitudinal direction of the respective body and the second recess of said first drumstick has a substantially circular outline.

4. The set of drumsticks according to claim 3, wherein the third recess of said first drumstick has a substantially oval outline.

5. The set od drumsticks according to claim 1, wherein the second and third recesses of said first drumstick are disposed substantially diametrically opposite each other.

6. The set of drumsticks according to claim 1, wherein each recess of said second drumstick has a substantially oval outline.

7. The set of drumsticks according to claim 1, wherein the recesses of said second drumstick are disposed substantially diametrically opposite each other.

8. The set of drumsticks according to claim 1, wherein each of said drumsticks has a first and a second end portion and said recesses are nearer to one end portion than to the other end portion of each of the respective drumsticks.

9. The set of drumsticks according to claim 1, wherein said cushion contains leather.

* * * * *